US007216444B2

(12) United States Patent
Muljadi

(10) Patent No.: US 7,216,444 B2
(45) Date of Patent: May 15, 2007

(54) IRONING BOARD

(76) Inventor: Basuki Muljadi, 58 Brompton Road, Kensington, NSW 2033 (AU)

( * ) Notice: Subject to any disclaimer, the term of this patent is extended or adjusted under 35 U.S.C. 154(b) by 0 days.

(21) Appl. No.: 10/488,889

(22) PCT Filed: Sep. 12, 2002

(86) PCT No.: PCT/AU02/01244

§ 371 (c)(1),
(2), (4) Date: Sep. 2, 2004

(87) PCT Pub. No.: WO03/023123

PCT Pub. Date: Mar. 20, 2003

(65) Prior Publication Data

US 2005/0005481 A1 Jan. 13, 2005

(30) Foreign Application Priority Data

Sep. 12, 2001 (AU) ..... PR7650

(51) Int. Cl.
*D06F 81/02* (2006.01)
*D06F 81/08* (2006.01)

(52) U.S. Cl. ..... 38/137

(58) Field of Classification Search ..... 38/103, 38/137, 139, 140, 64, 66, 61, 142, 136, 104, 38/71; 108/1, 4, 48; 68/240
See application file for complete search history.

(56) References Cited

U.S. PATENT DOCUMENTS

| | | | | | |
|---|---|---|---|---|---|
| 580,017 | A | * | 4/1897 | Sutton et al. | 38/103 |
| 1,712,958 | A | * | 5/1929 | Hume | 38/61 |
| 2,120,340 | A | * | 6/1938 | Rear | 26/28 |
| 2,585,758 | A | * | 2/1952 | Fjermestad | 38/142 |
| 2,652,646 | A | * | 9/1953 | Cave, Jr. | 38/136 |
| 2,719,422 | A | * | 10/1955 | Golden | 68/240 |
| 3,430,370 | A | * | 3/1969 | Topliffe | 38/104 |
| 3,913,248 | A | | 10/1975 | Thompson | |
| 4,268,982 | A | * | 5/1981 | Andersen | 38/12 |
| 4,689,905 | A | * | 9/1987 | Vartan | 38/26 |
| 4,783,916 | A | * | 11/1988 | Whitehead | 38/71 |
| 4,903,421 | A | | 2/1990 | Saito | 38/137 |
| 4,956,929 | A | * | 9/1990 | Chirabandalsuk | 38/136 |
| 4,961,388 | A | * | 10/1990 | Simpson | 108/42 |
| 5,016,367 | A | | 5/1991 | Breen et al. | |
| 5,290,998 | A | * | 3/1994 | Couch et al. | 219/247 |

FOREIGN PATENT DOCUMENTS

| | | |
|---|---|---|
| EP | 0126 530 A | 11/1984 |
| EP | 0 382 727 | 8/1989 |
| EP | 0 576 989 | 6/1993 |

(Continued)

OTHER PUBLICATIONS

Patent Abstract of Japan, vol. 0186, No. 80 (c-1291), Dec. 21, 1994.

*Primary Examiner*—Ismael Izaguirre
(74) *Attorney, Agent, or Firm*—Steptoe & Johnson LLP

(57) ABSTRACT

An ironing board including a support (1); and, an ironing surface (2) having a substantially convex shape, the ironing surface (2) being movably mounted to the support (1) to allow the ironing surface (2) to be moved between first (2A) and second (2B) substantially perpendicular ironing positions.

10 Claims, 4 Drawing Sheets

FOREIGN PATENT DOCUMENTS

| | | | |
|---|---|---|---|
| EP | 0 659 926 | | 12/1994 |
| EP | 1 029 971 | A | 8/2000 |
| GB | 473 919 | | 10/1937 |
| GB | 581 299 | A | 10/1946 |
| JP | 06 269600 | A | 9/1994 |

* cited by examiner

IRONING BOARD

BACKGROUND OF THE INVENTION

The present invention relates to an ironing board, and in particular to an ironing board for use in the ironing of clothing garments.

DESCRIPTION OF THE PRIOR ART

The reference to any prior art in this specification is not, and should not be taken as, an acknowledgment or any form of suggestion that the prior art forms part of the common general knowledge in Australia.

Typically, ironing is achieved by placing a garment to be ironed on a flat surface and urging the garment against the flat surface using a hot iron to thereby cause the garment to be flattened. Normally, ironing is achieved using an ironing board formed from a flat heat resistant board supported parallel to the ground. The garments are laid on the board allowing the garments to be ironed in use.

However, traditional ironing boards suffer from a number of disadvantages. In particular, the garments are usually designed to fit on the human form and accordingly, it is often difficult to lay the body shaped garments flat on the ironing board. Secondly having the ironing board orientated in a horizontal position parallel to the ground can lead to difficulty in ironing some articles, in particular, because of the position in which the iron must be held.

Alternative solutions to the use of an iron and ironing board have been proposed. However, these techniques typically require the use of heated pressing rollers and accordingly, the equipment is usually bulky, expensive and difficult to operate. As a result, such techniques are only of limited use.

SUMMARY OF THE PRESENT INVENTION

In a first broad form the present invention provides an ironing board including:

a) A support; and, b) An ironing surface having a substantially convex shape, the ironing surface being movably mounted to the support to allow the ironing surface to be moved between first and second substantially perpendicular ironing positions.

The support is adapted to support the ironing surface above the ground in use. In this case, the ironing surface is typically substantially parallel to the ground in the first ironing position, and substantially perpendicular to the ground in the second ironing position.

The ironing surface is normally formed from the surface of an ironing member having a substantially oval cross section.

The ironing member typically defines an ironing axis, with the ironing member preferably being coupled to the support so as to allow rotation of the ironing member about the ironing axis.

Similarly, the support typically defines a support axis, with the ironing member preferably being coupled to the support so as to allow rotation of the ironing member about the support axis.

Optionally, the support includes a vacuum means and the ironing member includes a number of apertures defining flow paths extending from the ironing surface to the vacuum means, wherein in use, the vacuum means is adapted to draw air along the flow paths thereby urging garments against the ironing surface in use.

The support preferably includes a steam generator for generating high pressure steam.

In this case, the ironing board usually includes a hose for coupling to the steam generator, the hose defining a flow path to allow the steam to be directed onto garments positioned on the ironing member in use. Alternatively, or additionally the steam generator can be coupled to the flow paths so as to allow steam to be provided directly at the ironing surface.

The ironing surface may optionally include a number of fastenings adapted to fasten garments in a desired position in use.

The support may include a power supply for supplying power to an iron in use.

The end portion of the ironing surface may be optionally shaped like the top portion of a human torso wherein the end portion is preferably detachably coupled to the ironing surface.

BRIEF DESCRIPTION OF THE DRAWINGS

An example of the present invention will now be described with reference to the accompanying drawings, in which.

DETAILED DESCRIPTION OF THE PREFERRED EMBODIMENTS

Figure 1:
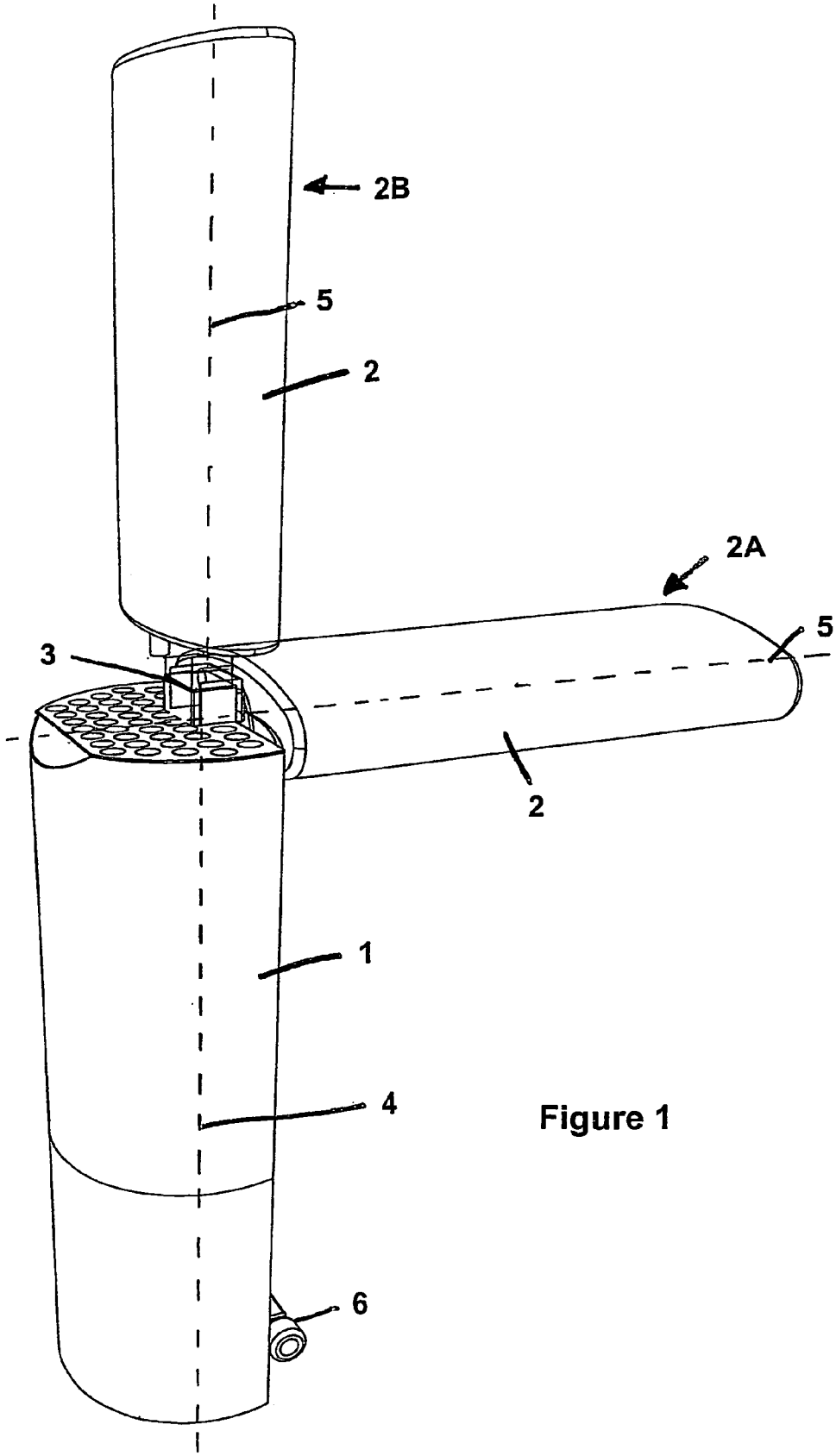
FIG. 1 is a schematic perspective view of a first example of an ironing board according to the present invention.

An example of an ironing board according to the present invention is shown in FIG. 1.

As shown in FIG. 1, the ironing board is formed from a support member 1 and an ironing member 2 coupled together via a joint 3. The ironing member is formed from heat resistant material allowing garments to be placed on the ironing member and ironed in use.

As shown, the ironing member 2 has a substantially oval cross-sectional shape such that the ironing surface provided by the ironing member is curved. As a result, when garments are positioned on the ironing member the garments, which are also typically curved to fit the shape of the human body, tend to conform to the shape of the surface of the ironing member more easily than would be the case if the surface were flat. It will be appreciated that this effect is enhanced if the ironing member 2 has dimensions similar to those of the human torso.

The joint 3 is adapted to allow the ironing member 2 to be moved between the position shown at 2A, in which the ironing member is substantially horizontal, and the position shown at 2B, in which the ironing member 2 is substantially vertical. This therefore provides the user with at least 2 different ironing positions.

In addition to this, the joint 3 also allows the ironing member 2 to be rotated about a first axis 4, that extends from the joint 3 to the base of the support 1, and a second axis 5, that extends from the joint 3 along the ironing member 2.

Accordingly, this allows the ironing member 2 to be rotated, as well as to be swivelled about the support 1, thereby allowing the ironing member 2 to take on a number of different orientations, as will be appreciated by a person skilled in the art.

Accordingly, when garments are positioned on the ironing member 2 in use, the ironing member 2 can be moved between the first and second positions 2A, 2B to allow the user to iron in the conventional orientation as well as in a vertical orientation, which is of particular use for example when ironing shirts, skirts or the like which can be positioned.

In addition to this, the ironing member 2 can be rotated around either one of the axes 4, 5 to allow the user access to the other side of the garment.

Accordingly, by providing an ironing surface that can be reorientated in this manner, this allows users to iron an entire garment without having to remove the garment form, or reposition the garment on, the ironing member 2.

The support 1 is also usually provided with wheels 6, as shown to allow the ironing board to be easily moved without requiring the full weight of the board to be lifted.

Figure 2:
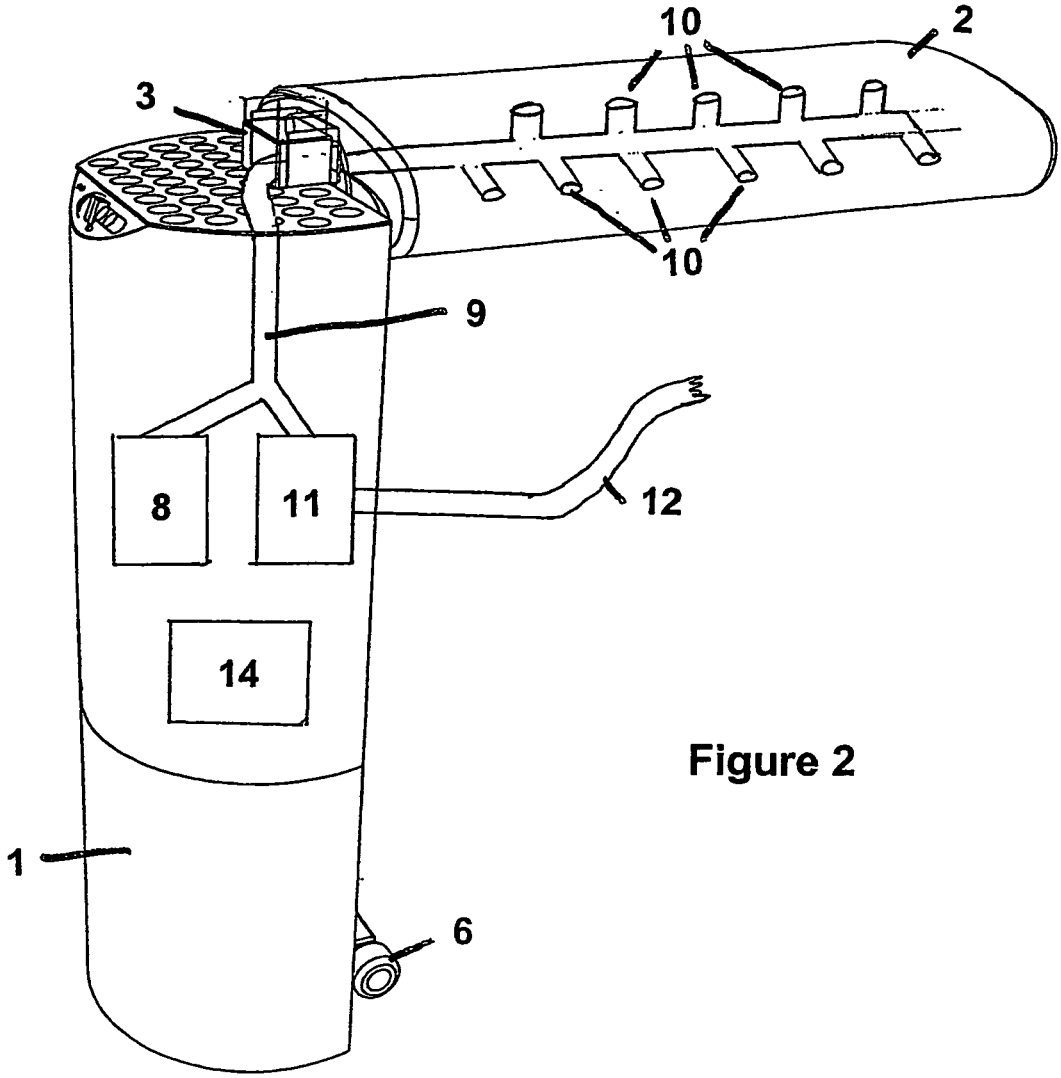
FIG. 2 is a schematic perspective view of a second example of an ironing board according to the present invention.
Figure 3C:
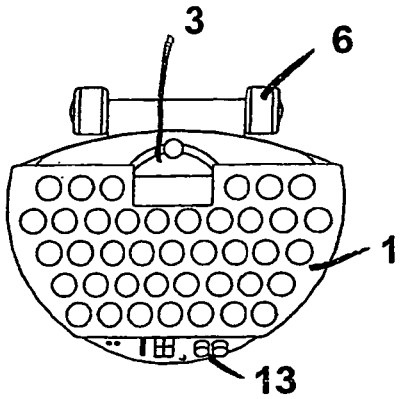
FIGS. 3A, 3B, 3C are schematic front, side and top views of the support of FIG. 2; and, FIGS. 4A and 4B are schematic views of a third example of an ironing board according to the present invention.
Figure 3A:
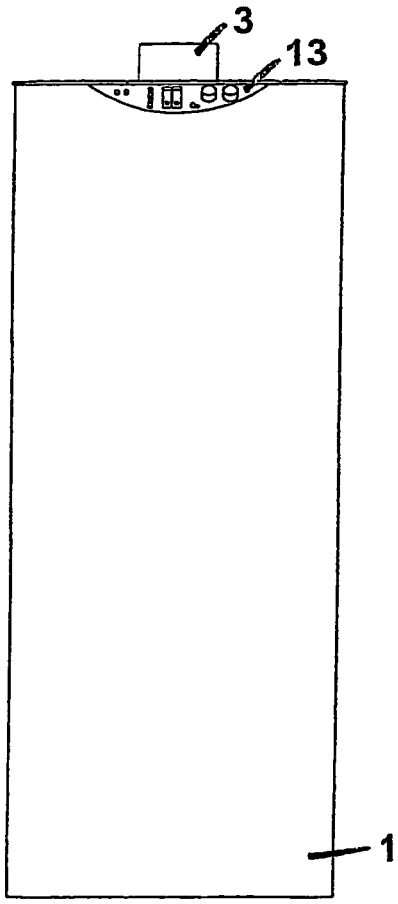
Figure 3B:
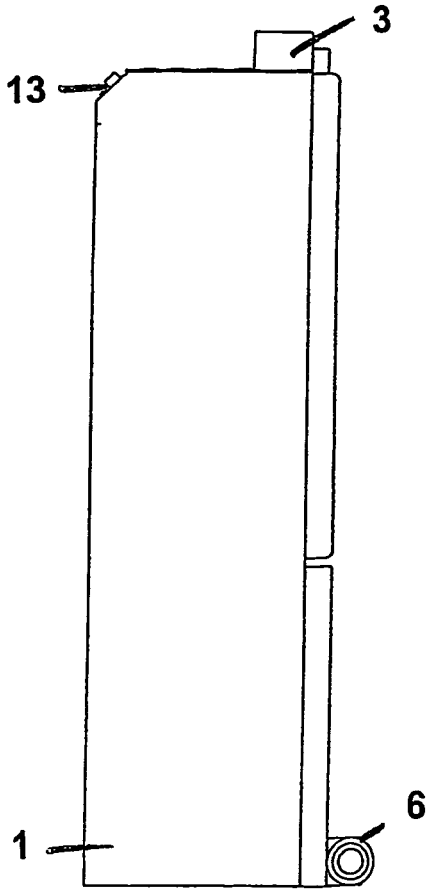

A second example of an ironing board according to the invention is shown in FIG. 2. In this example, only the position 2A of the ironing member is shown for clarity. In this example, the ironing board includes a vacuum system and a steam system, as will now be described.

The vacuum system is formed from a vacuum pump 8, coupled via a flow path 9, which extends through the joint 3, to a number of apertures 10, formed in the surface of the ironing member 2. In use, when the vacuum pump is activated air is drawn in along the flow path 9 via the apertures 10. Accordingly, when a garment is placed on the ironing member, the sucking action of the vacuum pump causes the garment to be urged against the ironing surface in use. This helps ensure that the garment is retained in position flat against the ironing surface, in use. In addition to this, if the garment is being steamed, the vacuum system helps draw the steam through the garment, thereby aiding the action of the steam, as well as reducing the time taken for the garment to dry. It should be appreciated that any means which provides that air flows into the apertures 10 of the ironing surface, thereby providing a sucking action, may be used in said vacuum system, such as for example a fan.

In addition to this, a steam generator 11 may also be provided. In this case, the steam generator 11 may also be coupled to the flow path 9 to allow steam to be transferred to the garment via the apertures 10. It will be appreciated that in this case, because the steam generator 11 is operate to steam the garments via the apertures 10, then the vacuum system cannot be used.

This can be overcome in two ways. Firstly, an alternative flow path 9 and separate set of apertures 10 could be provided for each of the vacuum system and the steam system.

Secondly, the steam generator 11 can also be coupled to an external hose shown schematically at 12. In this case, the steam generated by the steam generator is output via the hose 12. This allows the user to hold the hose 12 so as direct steam onto the garment in use as required.

It will be appreciated that the steam generated by the steam generator 10 can also be used to provide high pressure steam that can be used for cleaning purposes, such as cleaning kitchen dirt including lime deposits, coffee stains, grease or the like, as well as cleaning curtains or other fabrics.

Controls for controlling the vacuum pump 8 and the steam generator 11 are provided as shown generally at 3, in FIGS. 2, 3A, 3B and 3C.

The support 1 can also incorporate a power supply 14 to supply power to the iron in use. The allows the support 1 to be wired to an electrical supply, such as mains electricity, and then have the iron plugged into the support 1. This helps prevent the user having to arrange the ironing board in a particular orientation to allow the irons power supply cord to reach an electrical socket.

As an additional feature, the ironing member 2 may be provided with fastenings, such as clips (not shown) to allow the garments to be fastened to the ironing member in use. This allows the user to stretch the garments securely to make difficult tasks such as creating pleats on items easier.

Furthermore, it will be appreciated that the joint 3 may be adapted to allow the ironing member 2 to be orientated at any orientation between the positions shown at 2A, 2B.

Figures 4A, 4B:
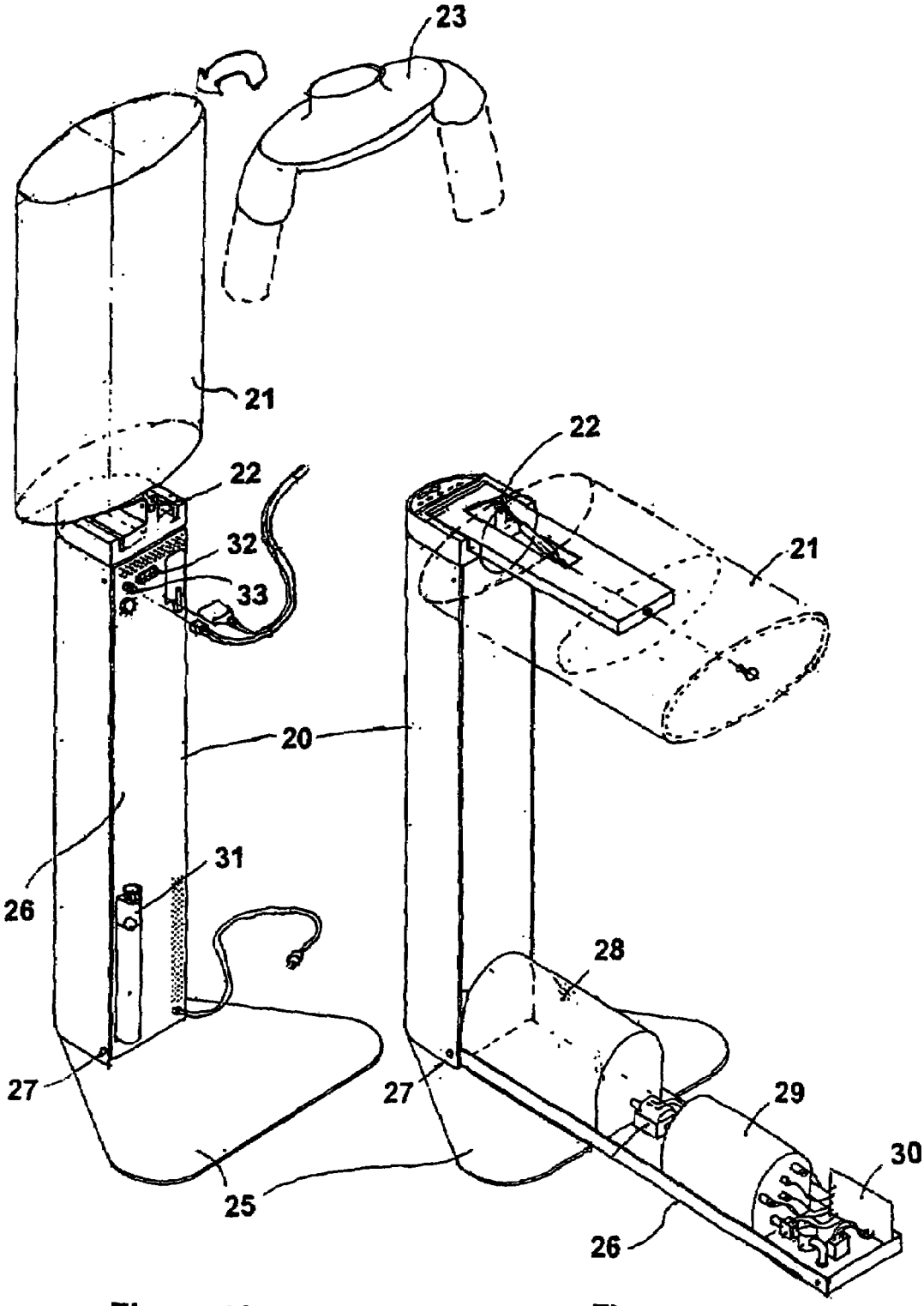

A further example of an ironing board according to the present invention is shown in FIGS. 4A and 4B. In this embodiment, the support member 20 is in the form of a more compact design coupled to a substantially planar base plate 25 which provides added stability to the ironing board. The support member 20 includes a panel 26 which is pivoted at point 27 and moveable between a closed position (shown in FIG. 4A) and an opened position (shown in FIG. 4B) providing easy access to the interior of the support member 20 which may include a water tank 28, boiler 29 and/or electronic components 30. A water gauge 31 may be fitted in connection with the water tank 28 in order to provide a visual indication of the level of water contained in said water tank 28 when the panel 26 is in the closed position.

The ironing member 21 is shown in a first position in 4A, in which the ironing member 21 is substantially vertical, and the position shown in 4B, in which the ironing member 21 is substantially horizontal position, providing a user with at least two different ironing positions. It will be appreciated however, that the joint 22 may be adapted to allow the ironing member 21 to be orientated and fixed at any orientation between the positions shown in FIGS. 4A and 4B.

A shirt attachment 23 is depicted in FIG. 4A, the shirt attachment 23 being similar in shape to the top portion of a human torso. This shirt attachment may be detachably coupled to the end portion of the ironing member to aid in the ironing of shirts and/or upper body garments.

Finally a power supply point 32 and/or steam supply point 33 may be located on the support member 20 for easy accessibility by an ironing handpiece.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. An ironing board including:

a) a support; and, b) an ironing surface having a substantially convex shape, the ironing surface being movably mounted to the support to allow the ironing surface to be rotated about the support between first and second substantially perpendicular ironing positions, the support being adapted to support the ironing surface above the ground in use, and the ironing surface being substantially parallel to the ground in the first ironing position, and substantially perpendicular to the ground in the second ironing position.

2. An ironing board according to claim 1, the ironing surface being formed from the surface of an ironing member having a substantially oval cross section.

3. An ironing board according to claim 2, the ironing member defining an ironing axis, the ironing member being coupled to the support so as to allow rotation of the ironing member about the ironing axis.

4. An ironing board according to claim 2, the support defining a support axis, the ironing member being coupled to the support so as to allow rotation of the ironing member about the support axis.

5. An ironing board according to claim 2, the support including a vacuum means and the ironing member including a number of apertures defining flow paths extending from the ironing surface to the vacuum means, wherein in use, the vacuum means is adapted to draw air along the flow paths thereby urging garments against the ironing surface in use.

6. An ironing board according to claim 1, the support including a steam generator for generating high pressure steam.

7. An ironing board according to claim 6, the ironing board including a hose for coupling to the steam generator, the hose defining a flow path to allow the steam to be directed onto garments positioned on the ironing member in use.

8. An ironing board according to claim 1, the support including a power supply for supplying power to an iron in use.

9. An ironing board according to claim 1, wherein the end portion of the ironing surface is substantially shaped like the top portion of a human torso.

10. An ironing board according to claim 9 wherein the end portion is detachably coupled to the ironing surface.

* * * * *